United States Patent [19]

Brock et al.

[11] 4,430,686

[45] Feb. 7, 1984

[54] CHARGER FOR ELECTROGRAPHIC SURFACES

[76] Inventors: Alan J. Brock, 26 Strangways Ter., North Adelaide, South Australia 5006; Alwin S. Clements, 35 Alexander St., Largs Bay, South Australia 5016; Brian J. Horrocks, 12 Martins Rd., Paralowie, South Australia 5108, all of Australia

[21] Appl. No.: 341,996

[22] PCT Filed: May 12, 1981

[86] PCT No.: PCT/AU81/00056

§ 371 Date: Jan. 12, 1982

§ 102(e) Date: Jan. 12, 1982

[87] PCT Pub. No.: WO81/03387

PCT Pub. Date: Nov. 26, 1981

[30] Foreign Application Priority Data

May 13, 1980 [AU] Australia ..... PE3511
May 13, 1980 [AU] Australia ..... PE3512

[51] Int. Cl.[3] ..... H01T 19/00
[52] U.S. Cl. ..... 361/229; 361/235
[58] Field of Search ..... 361/213, 229, 230, 235; 250/324–326; 363/22; 331/113 A

[56] References Cited

U.S. PATENT DOCUMENTS 1,207,862 12/1916 Chapman ..... 361/213
3,076,092 1/1963 Mott .
3,383,624 5/1968 Fiala ..... 331/113 A
3,581,149 5/1971 Tanaka et al. ..... 361/229
3,942,079 3/1976 Brock .

FOREIGN PATENT DOCUMENTS 270426 9/1963 Australia .
287695 6/1966 Australia .
468631 3/1974 Australia .
51-128537 11/1976 Japan .
54-152889 12/1979 Japan .
1569208 6/1980 United Kingdom .
135090 1/1961 U.S.S.R. .
240602 8/1969 U.S.S.R. .

*Primary Examiner*—Harry E. Moose, Jr.
*Attorney, Agent, or Firm*—Cushman, Darby & Cushman

[57] ABSTRACT

A charger for electrophotographic surfaces wherein a pair of corona wires (1 and 2) are spaced apart parallel to but spaced from the surface (4) which is to be charged and have the corona-producing voltage applied between them, the wires preferably being enclosed in a shield (5) and there being a control electrode (3) behind the surface being charged, the electron field preferably being applied intermittently at a selected frequency by out-of-phase supply means comprising transformers (20, 21), transistors (22, 23) and cross coupling condensors (24, 25), the control electrode being earthed or having a potential applied thereto by means such as a battery (18 or 32).

3 Claims, 5 Drawing Figures

CHARGER FOR ELECTROGRAPHIC SURFACES

Figure 1:
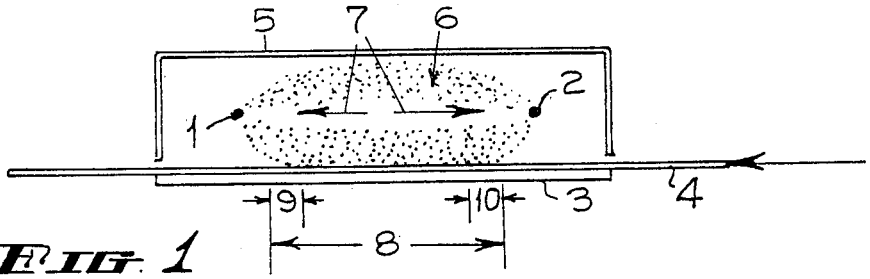

This invention relates to a charger for electrophotographic surfaces, to a method of charging such surfaces, and to the surfaces to be charged.

THE PRIOR ART

It is customary in electrophotography to have a surface on which is a layer of photosensitive material which is energized by first charging the surface and then light-bleeding the surface to produce an image and to then develop the surface with particles which are attracted to the surface according to the charge pattern.

This charging may be carried out prior to the actual exposure but it is necessary to then hold the charged surface in dark conditions to avoid bleeding away of the overall charge from the surface, but according to some systems the charging and exposure is carried out simultaneously, the latter being particularly required in what is termed a "one-shot" system, that is a system in which all colours are simultaneously developed as opposed to "step-wise" development according to which there is an exposure to a particular colour and a development of that colour and then an exposure to another colour and development in accordance with that colour and so on until a complete colour rendition exists.

In all of these methods however it is highly important to have an adequate form of charging of the surface and this has been one of the major problems in electrophotography in that the charging systems as known heretofore lack certain characteristics such as the maintaining of the surface in the condition where artifacts and spurious development is avoided which is caused extensively according to the present known systems due to the field from a corona puncturing the surface containing the photoconductor and thereby causing spots or absence of development according to whether a negative or positive development is used.

The problems associated with charging have been known for a long time and considerable prior art exists which teaches the problem of charge imperfection. Amongst the prior art documents is for instance the specification of Australian Letters Patent No. 462,918 Alan J. Brock, assigned to Repco Research Pty. Ltd., or the corresponding U.S. Pat. No. 3,942,079, in which various devices were suggested which resulted in a devious path of flow of the ions and electrons in a corona field to try and avoid ions reaching the sensitive area where puncturing and other problems are then caused. According to one form suggested the corona was formed between a point source and a remote electrode surface, and a stream of air was blown through the corona field on to an independent area which was to be charged, the basis being that the more acceptable components of the corona would be diverted by the airstream to charge the surface, the surface itself not receiving a direct charge.

A reference to three earlier patents number respectively Australian Letters Patent No. 478,069, Kenneth A. Metcalfe, Alwin S. Clements and Brian J. Horrocks, Australian Letters Patent No. 412,176, Ian E. Smith and Kenneth A. Metcalfe, and Australian Letters Patent No. 412,769 Kenneth Archibald Metcalfe, Frank Cecil Gillespie and Ian Edward Smith, all assigned to The Commonwealth of Australia, shows that it is well known that a corona contains bands of differing characteristic, and it was shown that there are bands of differing polarities in a corona outwardly from the centre of the corona. The above patent specifications teach that if certain precautions are taken it is possible to exclude harmful parts of the corona from the area being charged, but that was achieved at a considerable sacrifice to the simplicity of the mechanism by means of which the charging is carried out and only partly achieved the results aimed at.

One of the objects of the present invention is to provide an arrangement wherein a selected part of the corona only is available for charging a surface, a further object being to achieve this in a simple manner and with reliable operation, using charging wires extending across the area to be charged and having relative motion between the wires and area to be charged.

According to the prior art, excepting for the case of the air-blown corona referred to above and forms later described, the two electrodes between which the corona is formed were on opposite sides of the surface being charged, and it was customary for instance to have a backing plate on which the membrane containing the surface to be charged was positioned and to have on the other side a point or a series of points, usually movable to distribute the charge pattern, or a corona wire which had relative movement in relation to the surface to achieve the charging of a selected area.

It is known to use a pair of wire electrodes on one side of a surface being charged but according to the prior art methods the two-wire system was used to obtain a corona discharge from each electrode on to the surface being charged, the polarities being opposite on the two wires to produce as stated, for instance in the specification of Australian Letters Patent No. 287,696 of Rank Xerox Limited, and equal potential result, defined in that specification as used to charge the back of a dielectric member which carries powdered developer to a drum to develop a latent electrostatic image on the drum, and also in the specification of Japanese application No. 49-34208 of Canon K.K. where the two wires are connected to opposite ends of a transformer high-voltage winding to have a 180° phase difference to produce an "equal" potential result, a further specification of U.S. Pat. No. 3,076,092 of George R. Mott showing how the equal potential effect can be biassed to cause one polarity to be predominant when the two-wire two-corona system is used for charging a surface.

In the above specifications, there is a corona flow from each electrode to the surface which is to receive a charge as is shown clearly in the illustration of the Canon K.K. specification, and described in the other two specifications, the Canon K.K. specification showing a primary corona envelope between the two wires and a pair of secondary charging coronas extending separately from each wire to adjacent zones of the area being charged. The corona envelope does not extend to the area being charged and the secondary charging coronas impinge at high angle on the surface to which the corona is directed and, as such secondary coronas are of the same general structure as the corona envelope, the ion cores of these impinge on the surface being charged in a manner similar to the usual prior art methods of charging using a wire electrode on one side of the surface being charged and a back member which forms the other electrode of the system.

According to the present invention the two wire electrodes between which the charge is applied are placed on the same side of the surface being charged and in a position such that the corona envelope which is formed between the electrodes sweeps the surface to be charged. The invention also uses a control electrode on the side of the surface opposite to the surface being charged, which electrode is connected to control the shape of the corona.

The arrangement causes part of the corona to "brush" the surface as opposed to "impinging" on the surface, that is charging occurs without high angle impact of ions.

While charging may be effected by applying steady voltage to the wires, the present invention teaches an improved technique using a pulsed supply having a higher frequency component on it with a diminishing amplitude, particularly useful for charging self-rectifying zinc oxide surfaces described later.

The invention avoids the intense concentrations of ions and electrons on the photoconductor particularly if it is a zinc oxide-resin coating which can cause "holes" in the charged regions by local repulsion of like charges causing a migration resulting in "no charge" spots.

The "pulsed ringing" charger as we term it, reduces the production of "holes" in the charged region by preventing the build up of unnecessary concentration of electrons by presenting a polarity reversal of decreasing magnitude after each major charge step.

The invention can conveniently comprise a pair of wires mounted on suitable insulators to extend in parallel but spaced relationship above the surface to be charged, with the two wires preferably equidistant from the surface but arranged adjacent to at least a control plate, and the required high voltage is then applied to the wires in such a way that they form a pair of electrodes between which the electron flow will take place. The corona so formed will then spread outwardly from each of the electrodes to a somewhat larger cross-sectional dimension at a medial point between the electrodes to form an envelope the outer, or a selected part of which, is caused to contact the surface to be charged.

In this way for instance it is possible to ensure that the ions, which seem to cause the puncturing of the surface according to the older systems, flow generally between the two electrodes, and thus in a relatively parallel flow above the surface being charged, and therefore will have little or no effect on the surface.

The method of charging according to this invention thus comprises positioning a pair of spaced apart corona wires on one side of a planar control electrode extending generally parallel to a plane passing through the corona wires but spaced from the plane, applying a high voltage between the wires to cause a corona to be generated between the wires, causing the control electrode to have a potential lower than that of the corona, positioning an electrophotographic membrane which is to be charged between the corona wires and the control electrode, within the corona envelope but remote from the ion core, and causing relative movement between the electrophotographic membrane and the corona wires in a plane parallel to the corona wires.

The surface to be charged can conveniently be coated with zinc oxide. It is found that zinc oxide particles tend to aggregate during application, and with the object of reducing the aggregates to particles of the required fineness to give a smooth and satisfactory surface for producing high resolution, ball milling has been resorted to. Such ball milling was usually done in the presence of a resin which then coated the particles of zinc oxide to provide means of attaching the particles to a surface or to have them bedded in an insulating film.

It is generally thought necessary to resort to extensive milling first to produce the required fineness and secondly to uniformly cover the resultant particles with the resin, but after considerable research we have now found that the state of the zinc oxide as applied to a surface is highly important and it is our belief that the milling which has previously been resorted to had the effect of damaging the surfaces of the zinc oxide crystals to such an extent that their efficiency as a light-sensitive medium was impaired, and in some cases largely destroyed. We have been able to show that if sufficient abrasion occurs, the zinc oxide loses its ability to leak away a pre-applied charge.

It is clear from our experiments that electrophotographic properties of zinc oxides diminish with increase in milling, and an examination of zinc oxide particles produced by ball milling shows that the particles are damaged by excessive milling and it seems clear that one of the fundamentals in producing a good photoconductive coating is to handle the zinc oxide in such a way that there is a minimum of damage of scuffing of the crystal structure.

Research has also shown that zinc oxide can be produced of the required fineness with a retention of the crystalline form, and the present invention can be successfully used with that type of zinc oxide when coated with a thin layer of resin to give the necessary binding and insulating characteristic. It has been found that successful coatings of zinc oxide crystals with resin were obtained by sonic dispersal but it is however still necessary to resort to milling to produce the coating on the particles with the required shear, but we have found that if the material is "bar milled" instead of "ball milled" that greatly improved results are obtained.

A surface as described can be very effectively charged by the method outlined and the system results in a highly effective method of producing xerographic reproductions.

Figure 2:
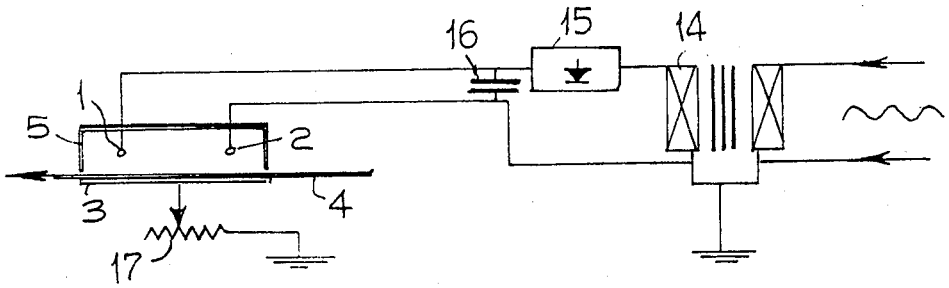
Figure 3:
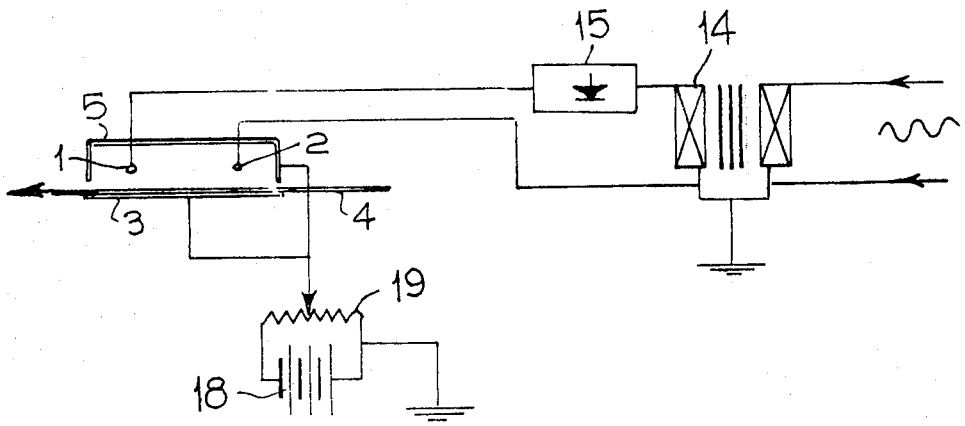
Figure 4:
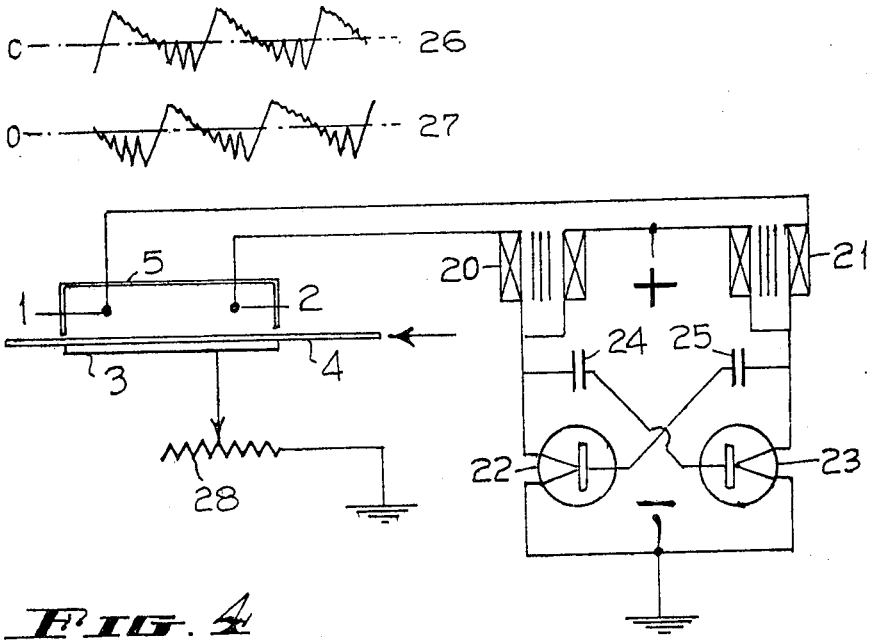
Figure 5:
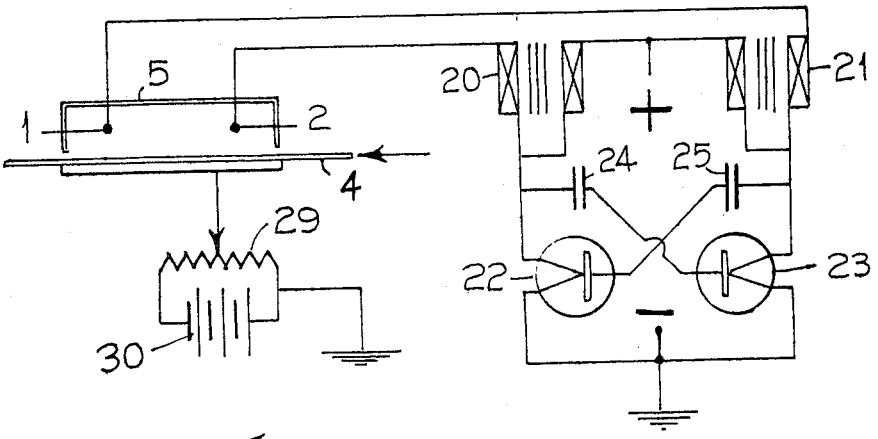

In order however that the invention may be more fully understood, embodiments thereof will now be described with reference to the accompanying drawings in which:

FIG. 1 is a schematic end elevation of an assembly which shows the electrode cloud and ion streams which result according to our invention, FIG. 2 is a schematic view of a pair of corona wires positioned above a control plate and disposed within a shield, showing a membrane being charged, the differential voltage between the corona and control plate being achieved by earthing the control electrode through a variable resistance which allows the control plate to "float" toward the potential of the said corona wires to avoid excessive electron or ion flow from the wires directly to the membrane being charged, FIG. 3 shows how the control plate can have a voltage applied thereto to simulate the floating effect of FIG. 2, FIG. 4 shows the electrical current whereby "ringing" charged effects is achieved, and FIG. 5 shows a variation of FIG. 3.

In the drawings similar components are generally given the same reference number.

The invention can of course be carried out in many ways, but according to the form shown a pair of wire electrodes are spaced a required distance apart and have the necessary high voltage applied between them, and when in use these wires are mounted on a carriage to be moved over a surface which is to be charged, or the surface can move with the wires remaining in position, or in some cases, using appropriate voltages and spacing distances between the two electrodes and suitably positioning the electrodes in relation to the surface, a sufficient field area is available to charge without either surface having any movement.

In the drawings the wires designated 1-2 are associated with a control plate 3 which is spaced from the wires to form a charging gap through which the membrane 4 to be charged is passed, and this control plate is either earthed through a control as shown in FIG. 2 or has a bias applied thereto as shown in FIG. 3.

In the drawings a shield 5 is shown on the opposite side of the wires from the control plate 3 to further control the corona, but this is not always necessary but is preferred.

Referring more particularly to FIG. 1, the wires are connected to have a high voltage applied between them so that there is a flow of electrons and ions in the form of an envelope having a medial core of ions, shown as a dotted area 6; which extends outwardly to touch the membrane 4 under control of the control electrode 3, the ion flow occurring between the electrodes as indicated by the arrows 7.

In research it has been found that when a control plate 3 is positioned as shown particularly in FIG. 1, the electron flow is uniform over the surface between the points indicated by the distance 8, both the control electrode 3 and the shield 5 extending this distance so long as at least the control plate is earthed through a resistance, preferably adjustable, or has a potential applied thereto. The control electrode appears to cause the electron flow to extend over the surface and it was found that without this plate at correct potential some charge appears to concentrate at the areas 9 and 10. The control electrode thus serves to prevent ion or excessive electron flow at the "high-angle" position which occurs for instance in the Canon K.K. device.

In FIGS. 2 and 3 the corona generating device comprises a high-voltage transformer 14 and rectifier 15 to give either a direct current when a condenser 16 is shunted across the high voltage of the secondary of the transformer, or a pulsating current of selected polarity, and the two sides of the secondary of the transformer are connected respectively to the wire electrodes 1 and 2 to generate an electron flow which includes ions, across the gap between the electrodes.

As stated earlier by earthing the control electrode 3 through a variable resistance 17, it is found that electrons are spread over the surface of the membrane in a very uniform manner but ions flow generally between the corona wires and consequently do not strike the electrophotographic surface of the membrane 4.

In practice further improved flow is found to exist if the shield 5 is electrically connected to the control electrode 3 as shown in FIG. 3.

FIG. 3 shows a voltage applied to the control electrode 3 and shield 5 from a source 18 through a potentiometer 19 as this may enhance charging under some conditions.

Referring now to the device of FIG. 4, which is used to charge a zinc oxide or other surface which is self rectifying so that it can support only one polarity and therefore does not require a bias as defined in the aforesaid "Mott" specification, the pair of corona wires 1 and 2 are again used as is the control electrode 3 and shield 5 but a modified corona voltage generator has a pair of transformers 20 and 21 connected in push-pull and driven by a pair of transistors 22 and 23 with oscillation produced by coupling condensers 24 and 25.

This produces a wave form shown in the figure, the wave forms shown at 26 and 27 being identical but having different phasing to produce an oscillating corona between the corona wires 1 and 2.

The control electrode 3 is in this case connected to earth through a variable resistance 28.

The device of FIG. 5 differs from that of FIG. 4 in that while the corona producing voltage of the transformers 20 and 21 is applied between the corona wires 1 and 2, and the control plate 3 is connected to the potentiometer 29 which has a voltage applied across it by a battery 30, one side of the battery 30 and the potentiometer 29 being connected to earth.

In both FIGS. 4 and 5 the shield 5 can be connected to earth or to the control electrode 3.

As generally there must be relative motion during charging between the corona wires and the membrane being charged, the assembly of FIG. 1 can be mounted on a movable frame or they could form part of a belt so that they can be driven across the surface in a continuous manner but whatever system is used it will be realised that the electrodes will be on one side only of the surface so that the corona is formed "across the surface" as opposed to "through the surface". By appropriately selecting the area of the corona which contacts the surface to be charged, the charge can have a predetermined and constant configuration which will avoid puncturing of the surface and will ensure that the part of the corona most suitable for the charging will be the active part.

The actual corona can be formed in various ways and can be a simple high voltage which in practice contains a high frequency component because of the inherent effects of a corona caused by pressure surges as the electrons are forced from the electrodes, but similarly it is possible to so generate the corona that for instance there is an application of a negative charge for part of a cycle and a positive charge for another part of the cycle, and by making one of these of greater magnitude than the other, such as by shifting the "O" up or down, it is possible to pulse the surface to give a major charge of one polarity but which charge is constantly reduced in value and rebuilt to give a required effect. This can be achieved by means such as those described in the specification of Australian Letters Patent No. 478,069 in the name of Kenneth Archibald Metcalfe, Alwin Spencer Clements and Brian John Horrocks (referred to earlier herein) and assigned to The Commonwealth of Australia.

Similarly by building a selected high frequency on to the corona, which can still be a pulsed corona, the corona frequency, or the frequency on a carrier of the corona, can be selected to be more effective with certain particles on or in the surface which is being charged, and it will then be possible to match the frequency of the corona to the frequency of selected particles on the surface being charged.

This will enhance the actual charging of the surfaces by a mutual interaction and energy exchange, and from this it follows that if for instance in a one-shot colour system three different components are in use which may represent the colours being used to form a colour image, these selective components can be differentially charged according to their charge acceptance when the charge is of a certain frequency or contains a band of different frequencies.

It is well known that a problem in colour reproduction by xerographic methods, in those cases where three colours are successively applied, is that great difficulty exists in maintaining the surface in a condition where it can be successively charged without charge interference, by developers successively applied, but by appropriate frequency selection of the corona and the developer particles the present method of charging helps to overcome at least some of these disabilities.

From the foregoing it will be realised that a novel method of charging results according to this invention in which instead of having a corona pass through the surface being charged or directly on to the surface being charged, the corona is now generated to be substantially parallel to the surface to extend over the surface, in contact with the surface, so that the envelope of the corona can be used to charge the surface by a "brushing" action as opposed to a "bombarding" action.

In the charger shown in FIGS. 4 and 5 the ringing produced by the high voltage coils 20 and 21 is in the higher frequency range, and it is found that this reduces the effective intensity of charge by the polarity reversals which offer an escape path for surplus electrons.

The normal intense charge gives a saturation condition whereas the "pulsed ringing" charger does not saturate, enabling a lesser exposure time, as the unsaturated ZnO coating allows easier bleeding away of the charge, particularly if used on a membrane coated with a layer of photosensitive zinc oxide applied to the membrane as a thin layer by suspending the zinc oxide particles in a volatile insulating liquid having dissolved in it an insulating bonding resin, and coating the said particles with a film of liquid by bar milling them in the liquid to resin coat the particles in the liquid before coating the membrane with the resin wetted zinc oxide particles and allowing the solvent liquid for the resin to evaporate.

We claim:

1. For charging an electrophotographic surface by means of a corona directed to the surface, apparatus comprising a pair of spaced-apart corona wires, a planar control electrode extending generally parallel to a plane passing through the corona wires but spaced from the said plane, means for applying a high voltage between the said wires to cause a corona comprising an envelope with an ion core to be generated between the said corona wires, means to cause the said control electrode to have a potential of the same polarity but less than that applied to the said corona, means positioned to guide an electrophotographic membrane which is to be charged between the plane of the said corona wires and the said control electrode in a position to intersect the said envelope outside of the said core, and means to cause a relative movement between the said membrane and the said corona wires in a plane parallel to the said corona wires, said means for generating the corona comprising a first and second transformer connected together by means arranged to produce an electrical oscillation in the said transformers of opposite phase, the output of one said transformer being connected to one said corona wire and the output of the other said transformer being connected to the other said corona wire whereby to produce a corona between the said wires.

2. The apparatus of claim 1 characterised in that the said oscillation-producing means comprise a pair of transistors connected one to the said first transformer and the other to the said second transformer, and a pair of condensers connected, one between the said first transformer and the second said transistor and the other between the said second transformer and the first said transistor whereby to produce in each said transformer a "ringing" potential of opposite phase in each said transformer.

3. The apparatus of claim 1 wherein the electrophotographic surface to which the said corona is applied comprises a layer of photosensitive zinc oxide applied to a membrane as a thin layer by suspending the zinc oxide particles in a volatile insulating liquid having dissolved in it an insulating bonding resin and coating the said particles with a film of said liquid by bar milling them in the said liquid to resin coat the said particles in the said liquid before coating the said membrane with the resin coated zinc oxide particles and allowing the solvent liquid for the resin to evaporate.

* * * * *